US006598523B1

(12) United States Patent
Kinoshita et al.

(10) Patent No.: US 6,598,523 B1
(45) Date of Patent: Jul. 29, 2003

(54) GRAVURE PRINTING METHOD

(75) Inventors: Muneaki Kinoshita, Kyoto (JP); Nobukatsu Nishida, 31-27, Nango 2-chome, Otsu-shi, Shiga 520-0865 (JP); Bin Tokunaga, Otsu (JP)

(73) Assignees: Sagawa Printing Co., Ltd., Kyoto (JP); Nobukatsu Nishida, Shiga (JP)

( * ) Notice: Subject to any disclaimer, the term of this patent is extended or adjusted under 35 U.S.C. 154(b) by 0 days.

(21) Appl. No.: 09/762,672

(22) PCT Filed: Aug. 17, 1998

(86) PCT No.: PCT/JP98/03651

§ 371 (c)(1),
(2), (4) Date: Feb. 9, 2001

(87) PCT Pub. No.: WO00/09343

PCT Pub. Date: Feb. 24, 2000

(51) Int. Cl.[7] ..... B41M 1/10
(52) U.S. Cl. ..... 101/170; 101/489; 101/DIG. 37
(58) Field of Search ..... 101/170, 489, 101/DIG. 37

(56) References Cited

U.S. PATENT DOCUMENTS 3,951,882 A * 4/1976 Markhart et al. ..... 524/447
3,991,253 A * 11/1976 Markhart et al. ..... 428/325
4,168,165 A * 9/1979 Kato et al. ..... 101/453
4,828,927 A * 5/1989 Timmerman et al. ..... 428/480
5,192,613 A * 3/1993 Work, III et al. ..... 428/363
5,238,801 A * 8/1993 Ishigaki ..... 430/530
5,405,681 A * 4/1995 Nakayama et al. ..... 101/170
5,637,383 A * 6/1997 Sakurai et al. ..... 428/211
5,707,554 A * 1/1998 Bennett et al. ..... 252/500
5,759,636 A * 6/1998 Taylor et al. ..... 427/498
5,829,355 A * 11/1998 Spengler ..... 101/170
6,120,954 A * 9/2000 Matsuda et al. ..... 430/47
6,221,210 B1 * 4/2001 Kurihara et al. ..... 162/100

* cited by examiner

*Primary Examiner*—Eugene H. Eickholt
(74) *Attorney, Agent, or Firm*—Hodgson Russ LLP

(57) ABSTRACT

An electrostatic gravure printing method wherein use is made of paper with a water content of 4–6% and a surface resistivity of $1.0\times10^9$–$9.0\times10^9\Omega/\square$ under the environment of 23±1° C. AND 50±2% RH. This method can thus limit the occurrence of missing dots in printed matters and eliminate the difficulty of page turning in the bound printed matter and electrostatic troubles such as unpleasant noise caused by electric discharge as pages are turned and separated.

5 Claims, 2 Drawing Sheets

GRAVURE PRINTING METHOD

TECHNICAL FIELD

The present invention generally relates to an art for preventing damages of printed matters due to static electricity, and particularly to a printing method for preventing various damages due to static electricity in a stack of plural paper sheets subjected to electrostatic printing.

BACKGROUND ART

As is well known in the art, in rotogravure printing, recess portions (cells) of dots representing characters or figures provided on the peripheral surface of a gravure plate cylinder are filled with ink. Then, continuous printing paper is allowed to pass the peripheral surface of the gravure plate cylinder while being pressed against the same by means of an impression cylinder, so that the ink in the cells transfers to a contact surface of the printing paper, thereby causing thecharacters or figures to develop on the paper surface.

In order to facilitate transfer of the ink from the inside of the cells to the printing paper, static electricity is used. Thus, in electrostatic gravure printing process, while continuous paper fed from a roll of paper is passed between the gravure plate cylinder and the impression cylinder, the paper is pressed against the surface of the plate cylinder by the impression cylinder, so that the printing ink filled in the cells of the plate surface of the gravure plate cylinder transfers to the surface of the paper, and consequently printing is accomplished.

The gravure printing ink is composed of electrically neutral fine particles. In the electrostatic printing, in order to achieve effective transfer of the ink from the cells of the plate cylinder to the surface of the paper, an electric field is generated in a nip portion between the plate cylinder and the impression cylinder. Thus, it is easy for the particles of the printing ink in the cells of the plate cylinder passing through this electric field to transfer from the cells to the surface of the paper by employing the force generating in the electrostatic field. Since the paper and the ink pass through the electrostatic field, the printing surface of the paper subjected to the electrostatic printing is uniformly charged positively and negatively.

In an automatic production process of magazines, catalogues and the like, continuous paper is printed at both sides and cut and folded into signatures. Then a certain number of signatures for forming a single book are stacked in the order of page, pushed at both sides thereof, tightly bound as one body, and fed into a book binding process, and consequently the stacks are formed into books.

The book produced in the above manner sometimes causes a problem that when a reader tries to turn pages, he can not easily separate each pair of pages opposing with each other because the opposing pages adhere to each other by electrostatic attraction. In such a case, if the reader misses the adhered pages or skips the pages without an effort of peeling the adhered pages, there remain pages that are not viewed by the reader, which will cause a trouble especially in the case of a sales catalogue. In addition, crackling sounds occurring at the time of turning pages will make the reader unpleasant. It is considered that the unpleasantness is caused by so-called electric discharge induced by separation.

In the book produced in the above manner, positive and negative electric charges due to the electrostatic printing remain uniformly on a printing surface of each page. Then, it is considered that between opposing pages of the book, an electrostatic force of $f=kq_1q_2/r^2$ acts according to Coulomb's law. Therefore, as the remaining electric charges increase, the effect of the electrostatic force increases. Furthermore, it is considered that the opposing pages of the book locally form a single capacitor consisting of oppositely charged printing surfaces with an air gap interposed therebetween. As is well known in the art, when dielectric constant of the air is defined as "ε", distance between the opposing pages as "d" and opposing surface area as "S", the capacity C of this capacitor is represented by the formula:

$$C = \frac{\varepsilon S}{d} \tag{1}$$

And when electric charge of the capacitor is defined as Q. electricpotential difference between the opposing pages, from the well-known formula Q=CV(2), V is represented as:

$$V=Q/C \tag{3}$$

As described above, since each page of the book is pressed and tightly bound in the course of bookbinding, "d" in the above formula (1) decreases to cause "C" to increase, and therefore, "V" decreases with increase in "C" because "Q" is fixed in accordance with a voltage applied in printing. However, when a readers turns the pages of a book, opposing pages are opened to rapidly increase "d" and hence "C" rapidly increases in the formula (1). As a result of this, the voltage difference V between the opposing pages forming the capacitor rapidly increases according to the formula (3) so that the electric charges cause so-called peeling electric discharge between these pages. This would be the reason for generation of the above-mentioned unpleasant sounds.

Paper conventionally used for gravure printing has a surface resistivity of generally more than or equal to $10^{10}\Omega/\square$. However, if electrostatic printing is performed by using this paper, the electrostatic troubles as mentioned above will occur due to the electric charges. As the surface resistivity of the paper is decreased to reduce the electric charge and rapidly attenuate static electricity, the surface conductivity of the paper is increased and the electric field strength of the aforementioned nip portion is weakened. Consequently, it is likely to generate so-called "missing dot" on the printing surface and deteriorate the quality of the printed matter. In recent merchandise catalogues, the number of pages tends to increase, and the desire to use thin paper arises from the viewpoint of transportation costs. However, such thin paper is much affected by the electric charges in turning of a page of printed matters because the firmness of the paper is weak.

DISCLOSURE OF INVENTION

The present invention suppresses occurrence of missing dots on the printing surface and prevents the above-mentioned electrostatic troubles from occurring due to the remaining electric charges in electrostatic printing by using paper having a surface resistivity of a predetermined range in electrostatic gravure printing.

According to a method of the present invention, paper having a surface resistivity in the range of $1.0\times10^9$ to $9.0\times10^9$ $\Omega/\square$, preferably $1.0\times10^9$ to $7.0\times10^9$ $\Omega/\square$, most preferably $1.0\times10^9$ to $5.0\times10^9$ $\Omega/\square$ is used. These values of surface resistivity are measured under the condition that a water content of the paper is in the range of 4% to 6%. The water content is measured under the environmental condition of 23° C.±1° C. in temperature and 50%±1° C. in temperature and 50%±2% in RH (relative humidity).

BEST MODE FOR CARRYING OUT THE INVENTION

In general, paper has a structure that a coating layer is applied on both sides of paper on which surface sizing treatment has been conducted after paper-making. The above-mentioned surface resistance preferable to the present invention can be realized by adding an inorganic salt to a sizing agent. As the sizing agent, those known in the art can be used. As the inorganic salt, various kinds and amounts that can realize the surface resistivity within the above-mentioned ranges may be selected appropriately. For instance, by making paper having a thickness of 50 $\mu$m to 55 $\mu$m on which surface sizing treatment has been- conducted with a sizing agent containing sodium chloride in a proportion of 0.15 g to 0.2 per 60 g of paper, it is possible to obtain paper having a surface resistivity of $1.0\times10^9$ to $9.0\times10^9$ $\Omega/\square$.

Figure 1:
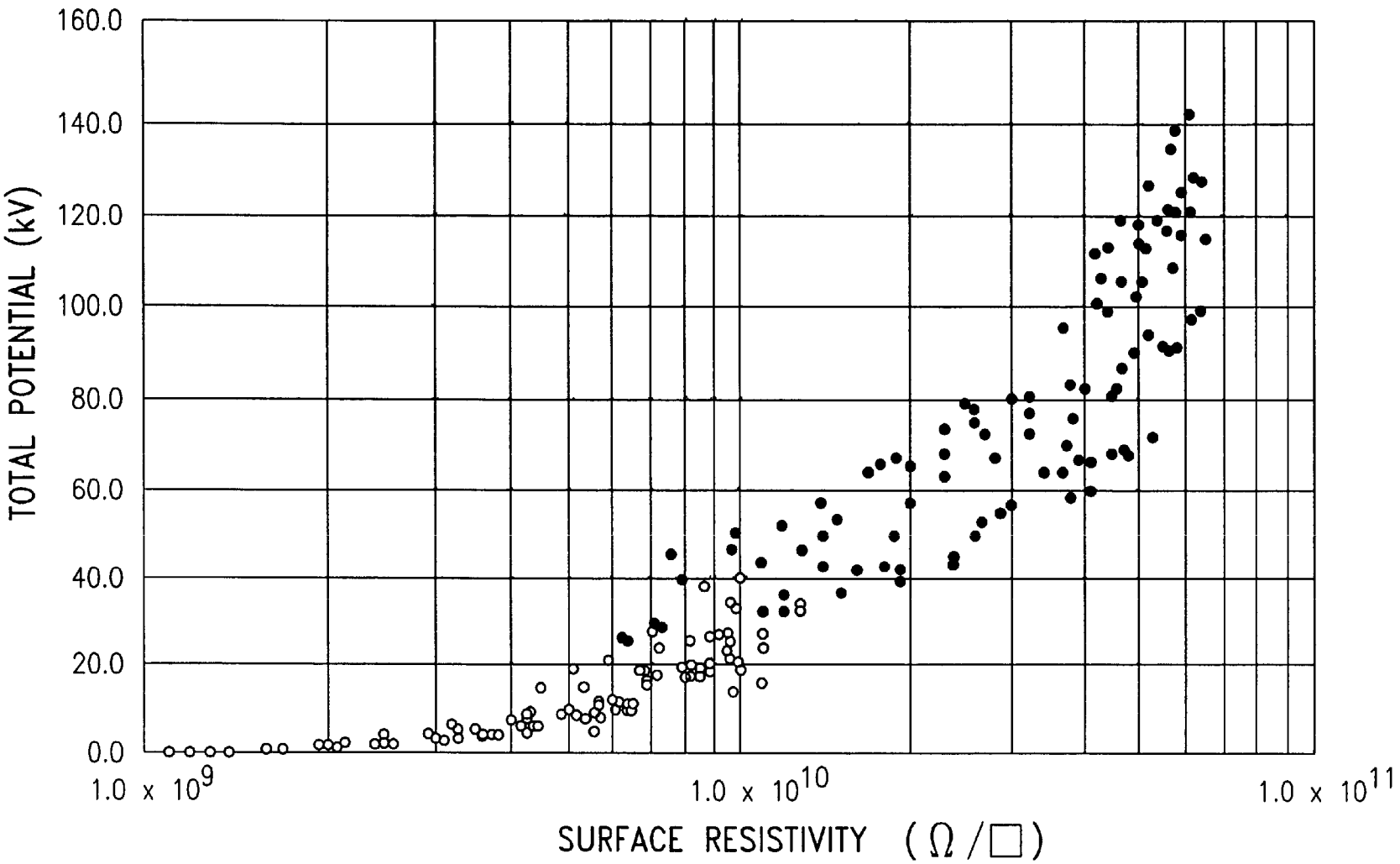
FIG. 1 is a view showing the relationship between surface resistivity of printing paper and total electric potential of a printed matter obtained from the paper.
Figure 2:
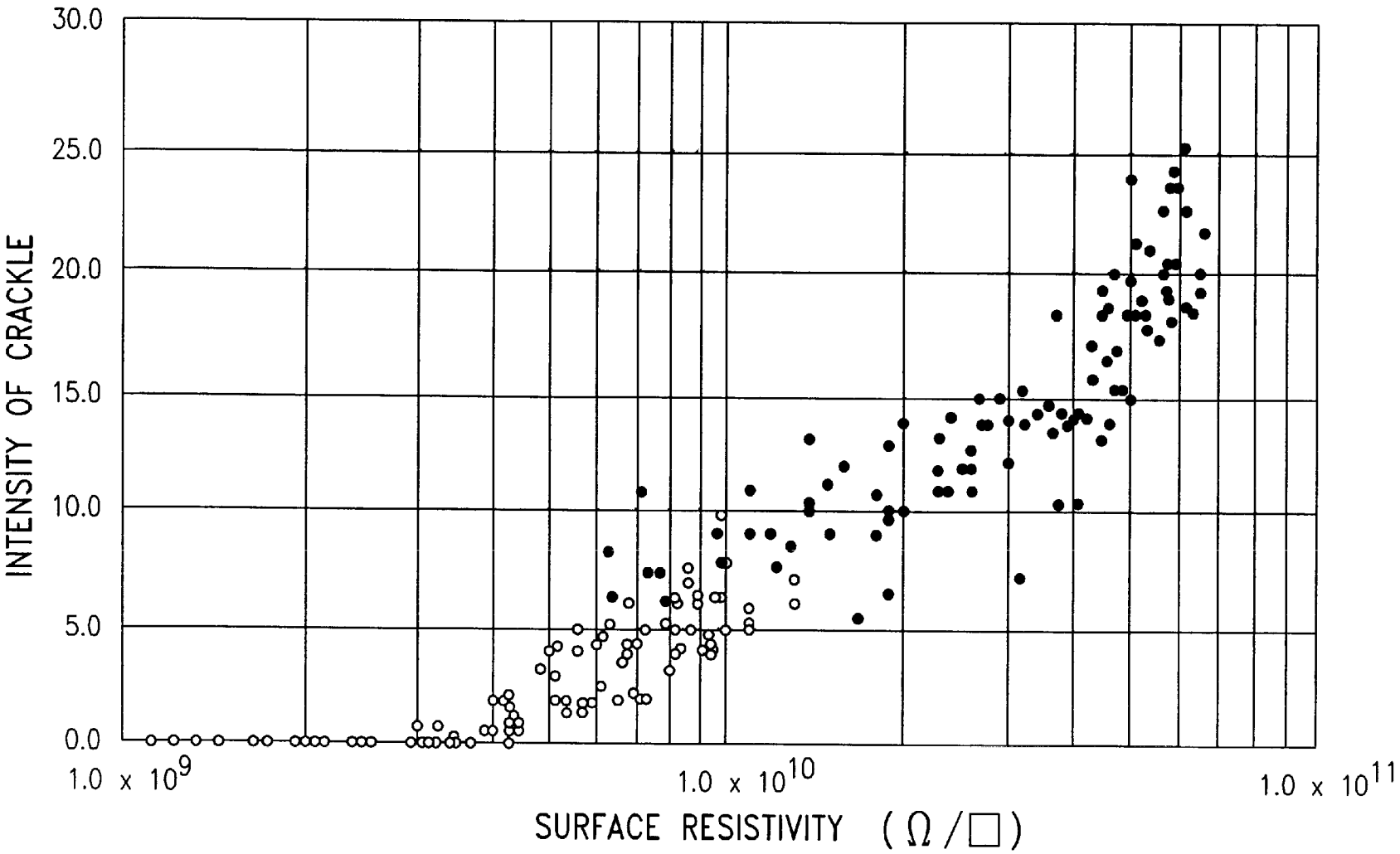
FIG. 2 is a view showing the relationship between surface resistivity of printing paper and the intensity. of crackle of a printed matter obtained from the paper.

In order to select the above ranges of surface resistivity, measurements of total electric potential and the intensity of crackle (crackling sounds generated at the time of turning a page of a book of printed matter) were made on printed matters obtained by electrostatic gravure printing on various kinds of paper having different surface resistivities. The results are shown in FIGS. 1 and 2. The measurements were made under the environmental condition of 23° C.±1° C. in temperature and 50%±2% RH (relative humidity).

In order to carry out the above measurements, 200 rolls of continuous paper having a definite amount of 64 g/m$^2$, a thickness of 55 $\mu$m, a width of 2450 mm and a length of 25000 m were prepared. 100 rolls out of those 200 rolls are made from paper subjected to surface sizing treatment with a sizing agent to which 0.2 g of sodium chloride per 60 g of paper is added and mixed (hereinafter, abbreviated as sodium chloride added paper). Another 100 rolls are made from conventional gravure printing paper subjected to surface sizing treatment with a sizing agent to which no sodium chloride is added and mixed (hereinafter, abbreviated as additive-free paper).

The surface resistivity was measured for each of 6 sheets of A4-sized paper pieces which were cut from a portion near the outermost circumference of each of the 200 rolls immediately before printing, by using a Resistivity Meter available from Mitsubishi Chemical Corporation, and the average value of six measured values was evaluated as a surface resistivity of each roll of paper.

The water content of paper was determined by cutting 6 pieces of paper of about 1 g from the portion of each roll where the 6 sheets of paper pieces had been cut out; measuring weight of each sample piece while drying them in an oven of 100° C.; regarding the state where the weight no longer changes as the absolute dry condition; and calculating the water content according to the formula, [Sample weight (g)—Sample weight in the absolute dry condition (g)]/Sample weight (g). For measurement, an electronic-type moisture meter available from SHIMADZU CORPORATION was used. For each roll, the average value of the water content of 6 paper pieces was evaluated as a water content of each roll of paper. It was confirmed that all rolls have the water content within the range of 4% to 6%.

The total electric potential and the intensity of crackle were determined by printing the same pattern, character and the like on all of the 200 rolls of paper under the same condition by electrostatic gravure printing; preparing 20,000 copies of an AB-sized merchandise catalogue of 72 pages for each roll; and arbitrarily selecting 3 copies among them and making measurements.

As to the total electric potential, an experimenter sequentially turned pages from the first page with his hand for each of the 3 copies to be measured which are selected from the printed matters of the above rolls. The experimenter measured the maximum value of the electric potential generated at the time of each turn at a position 10 cm apart from the copies to be measured, and calculated a sum of absolute values of measured values of 35 times measurements for each copy. Then the average value of each sum of absolute values of the 3 copies is determined as a total electric potential of the printed matters of each roll. For the measurement, an electric potential meter available from SHISHIDO Electrostatics Co. Ltd. was used.

As for the intensity of crackle, with the above-mentioned measurement of the total electric potential, the experimenter heard generated sound whenever he turned pages of each of 3 copies and ranked the sound volume into four ranks (large, intermediate, small and no sound). Then the experimenter assigned evaluation points of 3, 2, 1 and 0 for the respective ranks and evaluated the total evaluation points for each copy. The average value of each total evaluation points of the 3 copies is determined as the intensity of crackle of the printed matters of each roll.

In the graphs shown in FIGS. 1 and 2, open circles represent measured values for the above-mentioned 100 rolls of sodium chloride added paper, and closed circles represent measured values for the above-mentioned 100 rolls of non-additive paper. Since some of the measured values approximately overlap each other, the numbers of the respective circles are less than 100. The lateral axis represents a log scale.

For all of the printed matters to be measured, no difference was observed in occurrence of missing dots by a visual inspection in comparison with other printed matters even for the printed matters of paper having an especially small surface resistivity.

As is apparent from the above, there is a relationship between the surface resistivity of paper before printing and the total electric potential and the intensity of crackle of the printed matter using the corresponding paper and in the case of the paper having a surface resistivity of $1.0\times10^9$ to $9.0\times10^9$ $\Omega/\square$, the values of the total electric potential and the intensity of crackle of the printed matter are smaller than those of the paper having a surface resistivity exceeding the above range, particularly those of most non-additive paper, causing no practical troubles. In the case of the paper having a surface resistivity of $1.0\times10^9$ to $7.0\times10^9$ $\Omega/\square$, the values of the total electric potential and the intensity of crackle of the printed matter are smaller than those of almost all of the non-additive paper, and in the case of the paper having a surface resistivity of $1.0\times10^9$ to $5.0\times10^9$ $\Omega/\square$, the values of the total electric potential and the intensity of crackle of the printed matter are practically negligible. For instance, the sample of printed matter (a catalogue of 72 pages) from the paper having a surface resistivity of $4.8\times10^9$ $\Omega/\square$ which is determined to have a total electric potential of 8.6 kV, a maximum measured electric potential of 0.5 V, and the intensity of crackle of 3.3, generated crackling sounds of estimation point 1 for 3 or 4 times per a single copy in a page turning measurement, causing little unpleasantness and no adhesion of pages.

INDUSTRIAL APPLICABILITY

As described above, the printing method of the invention can suppress occurrence of missing dots in printed matters, as well as eliminate electrostatic troubles, so that it has an excellent applicability to gravure printing particularly using thin paper.

What is claimed is:

1. A gravure printing method, characterized in that electrostatic printing is performed by using paper having a water content of about 4% to about 6% and a surface resistivity of about $1.0\times10^9$ to about $9.0\times10^9$ Ω/□ under the environmental condition of about 23° C.±1° C. in temperature and about 50%±2% in RH (relative humidity).

2. The gravure printing method according to claim 1, characterized in that the surface resistivity of the paper is within the range of about $1.0\times10^9$ to about $7.0\times10^9$ Ω/□.

3. The gravure printing method according to claim 1, characterized in that the surface resistivity of the paper is within the range of about $1.0\times10^9$ to about $5.0\times10^9$ Ω/□.

4. The gravure printing method according to claim 1, characterized in that the paper has been subjected to surface sizing treatment with a sizing agent including about 0.15 g to about 0.2 g of an inorganic salt per about 60 g of paper.

5. The gravure printing method according to claim 4, characterized in that the inorganic salt is sodium chloride.

* * * * *